United States Patent [19]

Dannatt

[11] 4,365,139

[45] Dec. 21, 1982

[54] HEATED FUSER ROLL

[75] Inventor: Hugh S. L. Dannatt, Bethel, Conn.

[73] Assignee: Pitney Bowes Inc., Stamford, Conn.

[21] Appl. No.: 309,869

[22] Filed: Oct. 9, 1981

[51] Int. Cl.[3] ..... G03G 5/00; H05B 1/02

[52] U.S. Cl. ..... 219/216; 219/469; 355/14 FU; 355/3 FU

[58] Field of Search ..... 355/14 FU, 3 R, 3 FU, 355/14 R, 30; 219/216, 469, 470, 471, 504, 505; 338/22 R, 22 SD; 432/60, 228

[56] References Cited

U.S. PATENT DOCUMENTS

| | | | |
|---|---|---|---|
| T100,804 | 7/1981 | Ernst | 355/14 FU |
| 4,075,455 | 2/1978 | Kitamura et al. | 219/216 |
| 4,113,375 | 9/1978 | Murata et al. | 355/14 FU |
| 4,114,023 | 9/1978 | Zelinka et al. | 219/216 X |
| 4,161,644 | 7/1979 | Yanagawa et al. | 355/14 F UX |
| 4,253,007 | 2/1981 | Dannatt | 219/216 |
| 4,266,115 | 5/1981 | Dannatt | 219/216 |
| 4,329,566 | 5/1982 | Hooper | 219/469 X |

FOREIGN PATENT DOCUMENTS

| | | | |
|---|---|---|---|
| 55-60976 | 8/1980 | Japan | 355/14 FU |

*Primary Examiner*—A. C. Prescott

*Attorney, Agent, or Firm*—Melvin J. Scolnick; Albert Scribner; William Soltow, Jr.

[57] ABSTRACT

A heated fuser roll for use in a fuser apparatus for fixing toner images to a support surface is disclosed. The fuser roll includes a sleeve member having two heating units positioned within the member. Each heating unit includes a plurality of heating elements formed of a semiconducting ceramic material having a positive temperature coefficient of resistivity and exhibiting a Curie temperature transition point at which the resistance of the material increases with increasing temperature. The heating units are separated from each other by an insulating member. The fuser includes a thermally sensitive switch for controlling power to the heating elements when starting the fuser from a cold state. The switch is adapted to electrically connect the heating units in series when power is first applied to the fuser and then electrically connect the heating units in parallel when the heating elements are heated to the Curie temperature.

3 Claims, 3 Drawing Figures

HEATED FUSER ROLL

BACKGROUND OF THE DISCLOSURE

I. Field of the Invention

This invention relates to a heated fuser device as is commonly used in xerographic copying machines, and more particularly to a heated fuser roll whose heating elements are formed of a material that enables the fuser to be temperature-self regulating and which includes a thermally sensitive switching device that limits excessive current surges during the initial heat-up of the fuser.

II. Description of the Prior Art

In a typical xerographic process a photoconductor comprising a photoconductive composition coated on a rigid or flexible substrate is uniformly electrostatically charged in the dark, and then exposed by being illuminated in a image pattern in accordance with graphic material on an original document. The photoconductor becomes discharged in the areas exposed to the illumination, but retains its electrostatic charge in the dark areas, which areas correspond to the graphic material on the original document. The resulting elecrostatic latent image is developed by depositing on the photoconductor a finely divided electrostatically attractable developing material (toner), e.g. a heat fusible toner. The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is cleaned and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One very basic approach to fusing in a xerographic copying machine is the use of the so-called hot roll pressure fuser apparatus. Typically, in this apparatus, the paper with the toner image thereon is passed between a pair of opposed rollers, at least one of which is heated. Generally, the heated roll is formed of a hollow cylinder having a radiant heater, such as an infrared lamp or a halogen lamp, centrally located within the the cylinder to heat the roll, in series with a bimetal thermostat. A typical example of this type of heated fuser roll is illustrated in U.S. Pat. No. 3,637,976. During operation of the fusing apparatus, the paper to which the toner images are electrostatically adhered is passed through the nip formed between the rolls with the toner image contacting the fuser roll to effect heating of the toner image within the nip. Fusing is enhanced by the second roll, or pressure roll as it is commonly called, as the result of a biasing force which forces the rolls into engagement. The thermostat intermittently interrupts the current flow as the roll temperature reaches a predetermined value. The roll then cools to some lower temperature whereupon the thermostat restores the current, and the roll heats up again.

Many of the problems that occur with the use of a hot roll-pressure fusing apparatus are located within the heated fusing roll system. In particular, these problems relate to the means employed for heating the fuser roll and its control. For example, in many of the known hot roll fuser systems it is extremely difficult to maintain a constant temperature at the nip of the rollers where the actual fusing of the toner occurs, and where temperature control is critical. Temperature control is difficult because: (1) it is difficult to sense the temperature in this region; (2) thermal lag, i.e., the responsiveness of roll temperature under varying demands of thermal output; and (3) there are both different machine modes, i.e., standby, off, continuous operation, and different size papers to contend with. The type of thermostat control as described above is conspicuously oscillatory in nature. The thermostat by necessity being situated on the circumference of the roll in order to control the temperature of that surface, is relatively remote from the heater and, thus, the temperature fluctuations are usually significant. Reductions in this aforesaid differential temperature characteristic requires extensive and expensive proportional feedback control means. In addition to these problems, radiant-type heated fuser rolls generally require very high heating temperatures for the heating element to enable the roll temperature in the nip of the rollers to be high enough to melt the toner. The use of these high temperatures can result in deterioration of the fuser roll and thus limit the life of the fuser.

Examples of miscellaneous types of heated rolls that exhibit many of the problems as outlined above are illustrated in U.S. Pat. Nos. 3,471,683, 3,720,808 and 4,100,397.

To overcome many of the types of disadvantages of hot roll fusers as described above, it has been suggested in commonly assigned and copending U.S. patent application Ser. No. 041,024, filed May 21, 1979, entitled "Temperature-Self Regulating Fuser" by Donald T. Dolan, to use a fuser member that includes a heating element formed of a material which is capable of heating the fuser member to the required fusing temperature and which is temperature-self regulating. This type of heating element is formed of a semiconducting ceramic material that has a positive temperature coefficient of resistivity and that exhibits a Curie temperature transition point at which the resistance of the material increases with increasing temperature (PTC elements). When operating a fuser containing PTC heating elements, i.e. when the fuser is first turned on, there is an initial surge of current which is undesirable. The effective resistance of the PTC material may, when cold, be of some ten ohms; on heating, it may gradually fall to eight ohms and then as the Curie temperature is approached, it will rise to more than one thousand ohms in a space of about 10 centigrade degrees. It follows that if a number of these PTC elements are required in a fuser assembly, and if these are connected in parallel, as would be desired in a heavy duty fuser embodiment (a fuser used where many copies can be made), the startup resistance could be about 2 ohms or even less. If this fuser assembly were to be used in a xerographic copier operating on a 110 volt AC supply, i.e. normal household supply voltage, a switch on current of 55 amps would occur, which is unacceptable in domestic or small office applications. From an economical and practical point of view it would be desirable to significantly reduce this initial surge of current. One solution to this type of problem is described in my commonly assigned and copending U.S. patent application Ser. No. 199,175, filed Oct. 22, 1980 now U.S. Pat. No. 4,320,284 and entitled "Heated Fuser Roll."

SUMMARY OF THE INVENTION

It is therefore an object of the present invention to overcome many of the disadvantages of the hot roll fusers described in the prior art, and to provide a hot roll fuser (i) that is temperature-self regulating, (ii) will permit relatively simply control of the temperature of the roll in the critical area where fusing occurs, and (iii) will be able to limit the degree of the initial switch-on current surge.

It is a further object of this invention to provide a hot roll fuser which will provide a relatively even temperature gradient along its outer surface, avoid large temperature fluctuations, and eliminate center to edge temperature differentials.

It is still a further object of the invention to avoid the use of high temperature heating elements for heating a fuser roll, thereby avoiding deterioration of the fuser roll.

The foregoing objects and others are accomplished in accordance with the present invention by providing a heated fuser roll for use in a fusing apparatus for fixing toner images to a support surface, the fuser roll comprising a sleeve member having two electrically connected heating units positioned within the member, each heating unit including a plurality of heating elements formed of a semiconducting ceramic material having a positive temperature coefficient of resistivity and exhibiting a Curie temperature transition point at which the resistance of the material increases with increasing temperature. An insulating member is positioned between the heating units for separating each of the units. Included as part of the fuser is a thermally sensitive switching means to control power to the heating elements when starting the fuser from a cold state. The switching means is adapted to electrically connect the heating units in series when power is first applied to the fuser and thereafter electrically connect the units in parallel when the heating elements are heated to their Curie temperature.

The present invention also relates to the application of ceramic heating elements of a class known as positive temperature coefficient materials (PTC) which are disposed within the core of the fuser roll. The preferred ceramic material is described as ferroelectric and has the property of possessing low resistance up to some characteristic temperature. Upon attaining this temperature, the electrical resistance of the ceramic material increases typically from 10 ohms to 5000 ohms or more within a span of less than ten (10) degrees centigrade. It is thus to be appreciated that such a material may be configured to furnish its own thermostat, and furthermore since the effect is internal, pronounced and confined to a narrow temperature band, the oscillatory variations of temperature may be minimized. Such a system has advantages over the conventional and known methods of control. A heated fuser roll having the structure as herein described leads to superior control, avoids the problem of the "switch-on" current surges and an economical device. The self-limiting feature of the heating elements used in the roll eliminates temperature overshoot and promotes rapid heat up.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENT

Figure 1:
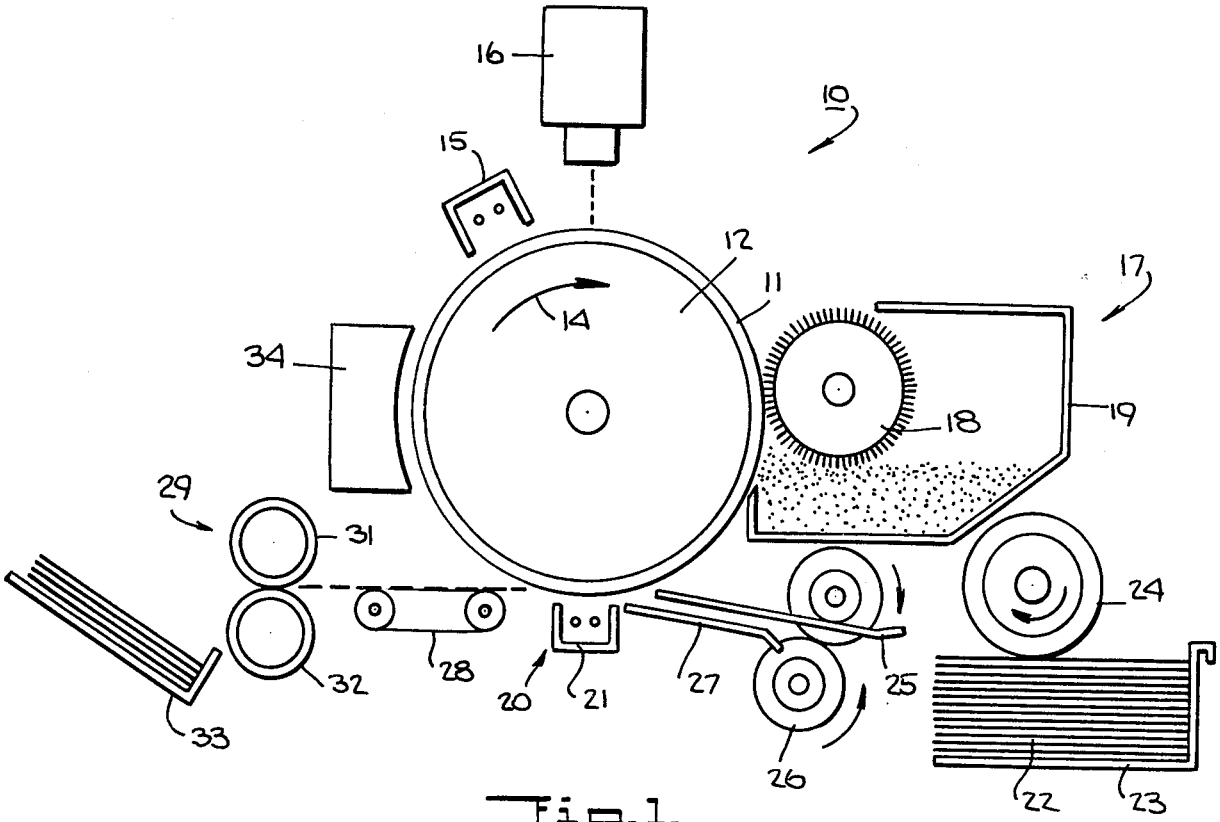
FIG. 1 is a schematic sectional view of a copier.

Referring now to the drawings and particularly to FIG. 1 thereof, there is shown an electrophotographic copying machine employing a fusing device in which a heated fuser roll in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of an xerographic process and, in particular, how a fusing apparatus is employed in such a process. A fusing apparatus employing a heated fuser roll in accordance with the present invention may be utilized in a wide variety of devices including coated paper copiers and plain paper copiers, and is not necessarily limited to the particular type of copier system shown in FIG. 1.

In FIG. 1, the reference numeral 10 generally designates an electrophotographic copying machine which includes a rotating drum 11 having a photoconductive surface 12 secured around the outer surface of the drum. Any of the numerous inorganic or organic photoconductive materials can be employed, such as, for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed faced down for copying. Overlying the platen would be a movable cover connected to one side of the carriage. An operator can raise and lower the cover and thereby place on or remove documents from the platen. A series of lamps would be used to illuminate the original document. By incorporating an optical system comprising mirrors and lenses a light image of the original document to be copied is projected onto the charged portion of the photoconductive surface 12. The movement of the carriage and therefore the scanning of the original document is in timed relationship with the movement of rotating drum 11. Thus, photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually formed of a heat settable plastic. However, a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of queuing rollers 26. At a predetermined time in the course of a copy cycle, the queuing rollers are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable stripping apparatus, and advanced by belt conveyor 28 to fixing station 29.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. As shown, the fuser apparatus includes a heated fuser member or roll 31, and a backup member or roll 32. The copy sheet with the toner powder image thereon is interposed betweeen fuser roll 31 and backup roll 32. A release material, e.g. polytetrafluoroethylene, can be on the fuser roll to prevent offset and allow for easy release of the paper from the roll. After the toner image is permanently affixed to the copy sheet, the sheet is separated from the fuser roll and advanced to a catch tray 33 for subsequent removal from the copier by an operator.

In order to remove residual toner particles which adhere to photoconductive surface 12 after the transfer of the powder image to the copy sheet, copying machine 10 is provided with a cleaning system generally designated by reference number 34. The cleaning mechanism can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Figure 2:
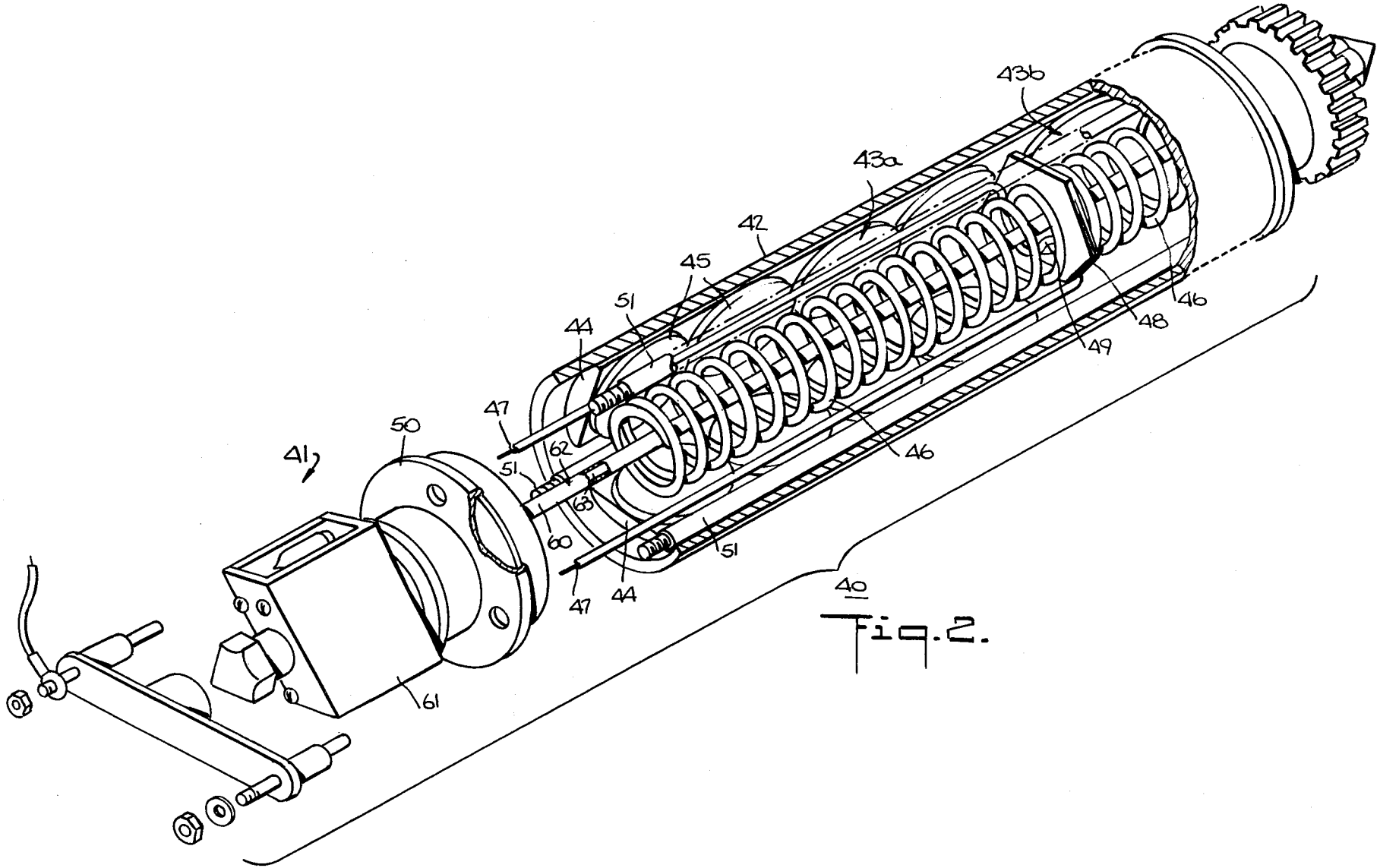
FIG. 2 is an exploded perspective view of an embodiment of a heated fuser roll with a thermally sensitive start-up switch in accordance with the present invention.

Referring now to the specific subject matter of the present invention, there is illustrated in FIG. 2 a heated fuser roll 40 including a thermally sensitive start-up switching means 41 in accordance with the features of the present invention. Specific details of the fuser roll 40 illustrated in FIG. 2 can be found in my commonly assigned and copending U.S. patent application, Ser. No. 199,175, filed Oct. 22, 1980. This fuser roll is illustrated herein as an example of one embodiment of the type of fuser roll structure that can be used with the present invention. As shown, fuser roll 40 is in the form of a metal cylinder illustrated as sleeve member 42. Positioned within the sleeve member are two heating units **43*a* and 43*b*. Each of heating units 43*a* and 43*b* include a plurality of axially disposed thermally conductive members 44 (members 44 provide the means for allowing the heat to flow from heating elements 45 to the working surface of the fuser roll), a plurality of heating elements 45, preferably wafer shaped, and spring member 46. In addition to spring member 46 exerting a force on heating elements 45 to increase the efficiency of the heat transfer from the heating elements to the working surface of the fuser, the spring also acts as the means by which electric current flows from the electric source to the fuser through wire conductors 47 to the spring and subsequently to each of the heating elements. Separating the two heating units 43*a* and 43*b* within fuser 40 is an insulating plate 48 which can be formed of any of the numerous types of insulating materials, such as, for example, glass epoxy. As shown in FIG. 2, each of spring members 46 abuts the insulating plate 48 along with wire lead 49 which in turn is connected to the electrical source for the fuser. Mounted to the end portions of sleeve member 42 are electrically non-conductive end plugs 50. End plugs 50 are secured to the sleeve member by rods 51** which are preferably covered by an insulating material.

Heating elements 45 are formed of a semiconducting ceramic material which has a positive temperature coeffficient of resistivity and exhibits a Curie temperature transition point at which the resistance of the material increases with increasing temperature. The preferred semiconducting ceramic materials embodied within the present invention have a Curie temperature or transition temperature such that when the material reaches its particular Curie temperature the resistance of these materials increases by several powers of ten. These materials, when employed as heating elements 45 impart to fuser roll 40 the ability to operate as a self-regulating heat source. At a given voltage the heating elements will draw a high current. This is because the elements are cold and their resistance is low. Within a few seconds the Curie temperature of the ceramic material is reached, there is a sharp increase in resistance, e.g. from 10 ohms to 5,000 ohms, and an immediate restriction in the amount of power absorbed. Thereafter, a state of equilibrium arises in which the power absorbed adjusts itself such that it is equal to the heat dissipated. Thus, the material tends to keep its temperature substantially in the vicinity of the Curie temperature. The particular ceramic material composition that is chosen for use as the heating element, of course, depends upon the fusing temperature requirements. In accordance with the present invention, ceramic semiconducting materials that exhibit Curie temperatures within the range of about 150 degrees C. to about 220 degrees C. are the preferred materials for use as heating elements 45 in view of the temperatures required to fuse most commercially available toners. Compositions comprising barium titanate with strontium titanate and/or lead titanate, and a small amount of lanthanum in the form of lanthanum titanate, e.g., 0.3 mol %, (lanthanum is added in sufficient amount to impart semiconductive properties to the material) are particularly well suited as compositions for these heating elements. Details of these ceramic materials as heating elements for fusers can be found in commonly assigned and copending U.S. patent application Ser. No. 041,024, filed May 21, 1979, entitled "Temperature-Self Regulating Fuser" by Donald T. Dolan. The heating elements are preferably in the form of circular wafers 45. An example of the physical dimensions for one preferred wafer-type heating element in accordance with the present invention would be a wafer having a diameter of about one inch and a thickness of about 0.126 inches.

As illustrated in FIG. 2 fuser roll 40 includes a thermally sensitive switching means 41 which consists of two basic elements, i.e. a thermostat 60 that is capable of measuring the temperature within fuser roll 40 and a switch mechanism 61. In accordance with the present invention, thermostat 60 is preset so as to activate switch 61 when heating elements 45 are heated to their Curie temperature. When electricity is first applied to fuser roll 40, the fuser is in a cold state and there is a relatively low resistance in the PTC heating elements 45. To prevent a sudden and undesirable surge of current across the fuser, switch 61 is set to connect the heating elements in heating units 43*a* and 43*b* in series so as to provide a system with a relatively high resistance. As the fuser heats up, and in particular when heating elements 45 reach their Curie temperature (i.e. temperature at which the resistance of the PTC material increases dramatically) thermostat 60 (which is preset to the Curie temperature of the heating elements) activates switch 61 so as to electrically connect the heating elements within heating units 43*a* and 43*b* in parallel, thereby lowering the overall electrical resistance across the circuit to help maintain the fuser at the proper fusing temperature. Note FIG. 3 which illustrates the electrical circuit diagram for switching means 61 with heating units 43*a* and 43*b*.

In a preferred embodiment in accordance with the present invention the thermally sensitive switching means 41 comprises a thermostat element 60 formed of a steel tubular stem 62 surrounding an internally located brass rod 63 which extends into switch 61 and extends axially throughout the length of fuser roll 40 as shown. Switch 61 includes two microswitches (not shown) which operate as a double-pole-double-throw switch and which are activated by the thermal expansion of the brass rod within thermostat 60. As previously stated, the thermostat is preset to activate switch 61 (i.e., change the electrical circuit connection of heating units 43*a* and 43*b* from a series connection to a parallel connection) when the Curie temperature of heating elements 45 is reached.

Figure 3:
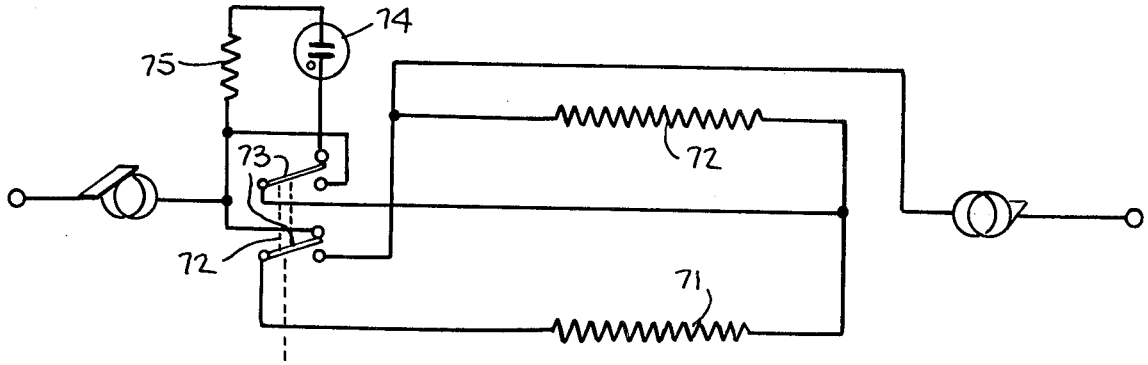
FIG. 3 is an electrical circuit diagram illustrating the electrical circuitry and components employed for controlling the heated fuser roll of FIG. 2.

Referring now to FIG. 3 there is specifically illustrated a circuit including resistor elements 70 and 71 which represent the resistance provided by the PTC heating elements in each of heating units 43*a* and 43*b* respectively. Dotted line 72 represents thermostat 60 which (when the brass rod therein expands a specific distance relating to the Curie temperature of heating elements 45) switches the double-pole-double-throw switch 73 whereby the PTC heating elements in heating units 43*a* and 43*b* are switched from a series connection (as shown) to a parallel one. Also shown in the circuit of FIG. 3 is a neon lamp 74 which can be used with the thermally sensitive switching means as an indicator as to when the fuser is heating up (heating elements 45 connected in series). When the Curie temperature of the PTC heating elements is reached, the circuit switches to connect the heating elements in heating units 43*a* and 43*b* in parallel and the neon lamp turns off. A primary purpose of including the neon lamp would be to enable a service person to be able to calibrate the thermostat to be sure it is switching at the correct temperature. Resistor 75 limits the current to the neon lamp to prevent the lamp from burning out.

While this invention has been described in conjunction with a specific embodiment thereof, it is evident that many alternatives, modifications and variations will be apparent to those skilled in the art. Accordingly, the present invention is intended to embrace all such alternatives, modifications and variations and fall within the spirit and scope of the appended claims.

I claim:

1. A heated fuser roll for use in a fuser apparatus for fixing toner images to a support surface, said fuser roll comprising:

a. a sleeve member;

b. two electrically connected heating units positioned within said sleeve member, each heating unit including a plurality of heating elements formed of a semiconducting ceramic material having a positive temperature coefficient of resistivity and exhibiting a Curie temperature transition point at which the resistance of said material increases with increasing temperature;

c. an insulating member positioned between said heating units for separating each of the units; and d. thermally sensitive switching means to control power to said heating elements when starting said fuser from a cold state, the switching means adapted to electrically connect the heating units in series when power is first applied to said fuser and then electrically connect said units in parallel when said heating elements are heated to said Curie temperature.

2. A heated fuser roll according to claim 1 wherein said thermally sensitive switching means comprises a thermostat device adapted to activate a switch arrangement for changing the heating units from a series to parallel connections.

3. A heated fuser roll according to claim 1 wherein said heating elements are wafer shaped.

* * * * *